US012167823B2

(12) United States Patent
Persson et al.

(10) Patent No.: US 12,167,823 B2
(45) Date of Patent: Dec. 17, 2024

(54) HOUSEHOLD APPLIANCE

(71) Applicant: Gorenje d.o.o., Velenje (SI)

(72) Inventors: Thomas Persson, Floby (SE); Martin Lindqvist, Skara (SE)

(73) Assignee: Gorenje d.o.o., Velenje (SI)

( * ) Notice: Subject to any disclaimer, the term of this patent is extended or adjusted under 35 U.S.C. 154(b) by 95 days.

(21) Appl. No.: 18/015,490

(22) PCT Filed: Jul. 10, 2020

(86) PCT No.: PCT/EP2020/069615

§ 371 (c)(1),
(2) Date: Jan. 10, 2023

(87) PCT Pub. No.: WO2022/008081

PCT Pub. Date: Jan. 13, 2022

(65) Prior Publication Data

US 2023/0248207 A1 Aug. 10, 2023

(51) Int. Cl.
*A47L 15/50* (2006.01)

(52) U.S. Cl.
CPC ..... *A47L 15/507* (2013.01)

(58) Field of Classification Search
CPC ..... A47L 15/507
See application file for complete search history.

(56) References Cited

U.S. PATENT DOCUMENTS 5,181,781 A * 1/1993 Wojcik ..... F16C 33/3856 312/334.44
6,113,204 A * 9/2000 Jahrling ..... A47B 88/40 312/334.44

(Continued)

FOREIGN PATENT DOCUMENTS

| | | | |
|---|---|---|---|
| CN | 104757923 | A | 7/2015 |
| DE | 102012100454 | A1 | 7/2013 |
| EP | 2891447 | A1 | 7/2015 |

OTHER PUBLICATIONS

Chinese Office Action, Chinese Patent Application No. 202080102843.6, dated Apr. 30, 2024.

(Continued)

*Primary Examiner* — James O Hansen
(74) *Attorney, Agent, or Firm* — MARSHALL, GERSTEIN & BORUN LLP

(57) ABSTRACT

A household appliance comprising: a support for goods arranged inside the household appliance; and an arrangement for extracting and retracting the goods support out from and into the household appliance, wherein the arrangement comprises: first and second rail units extending substantially along and in parallel with each other, wherein the first and second rail units are moveable in a longitudinal direction in relation to each other; and first and second sets of roller elements distributed longitudinally between the first and second rail units along first and second opposite outer surfaces of the first rail unit so as to facilitate said relative movement. The first rail unit is provided with supporting material in a region that extends between and is located intermediate to the first and second opposite outer surfaces so as to allow for absorption of compression forces in the supporting material and resistance of compression deformation of the first rail unit when one or more of the roller elements exerts a force onto any of the outer surfaces.

17 Claims, 12 Drawing Sheets

(56) References Cited

U.S. PATENT DOCUMENTS

| | | | | |
|---|---|---|---|---|
| 7,909,420 | B2 * | 3/2011 | Jahrling | A47L 15/507 312/351 |
| 2009/0096338 | A1 | 4/2009 | Jahrling | |
| 2010/0019637 | A1 * | 1/2010 | Guttinger | A47B 88/493 384/35 |
| 2012/0104914 | A1 * | 5/2012 | Jobst | A47L 15/507 384/7 |
| 2015/0190034 | A1 | 7/2015 | Jeong et al. | |
| 2015/0238063 | A1 * | 8/2015 | Jobst | A47L 15/507 312/319.1 |

OTHER PUBLICATIONS

International Search Report and Written Opinion, International Application No. PCT/EP2020/069615, mailed Mar. 24, 2021.

* cited by examiner

HOUSEHOLD APPLIANCE

TECHNICAL FIELD

This invention relates to a household appliance, such as a dishwasher machine, according to the preamble of claim 1. In particular, the invention relates to an arrangement for extracting and retracting a support for goods, such as a basket or rack, out from and into the household appliance.

BACKGROUND OF THE INVENTION

Dishwasher machines are typically provided with an arrangement for extracting and retracting a basket or rack arranged between opposite side walls of the machine. Such an arrangement may include two metallic rails arranged on each inner side wall of the machine, one rail being fixed to the wall and the other slidably arranged into the other, and a set of plastic wheels arranged at each side of the basket and fitted into the slidable rail. The basket can then be extracted by a combination of extracting the slidable rail and rolling the basket outwards using the wheels.

More recently, extracting/retracting arrangements have been proposed where the wheels have been replaced by roller bearings or similar structures intended to provide for more smooth extraction/retraction of the basket or other goods support. However, these arrangements are commonly rather costly and seem at least in some cases to exhibit questionable properties with regard to durability.

EP2891447A1 discloses an example of a dishwasher provided with a basket extraction/retraction arrangement including three rails and two ball bearings on each side of the dishwasher. Possibly, this arrangement is durable but it is more costly than conventional arrangements involving wheels attached to the basket.

There is thus still a need for improvements in the field of basket or goods support extraction/retraction arrangements for dishwashers and other household appliances.

SUMMARY OF THE INVENTION

An object of this invention is to provide a household appliance with a basket or goods support extraction/retraction arrangement that exhibit a reliable and user-friendly function and that provides for an improved cost efficiency. This object is achieved by the household appliance defined by the technical features contained in claim 1. The dependent claims contain advantageous embodiments, further developments and variants of the invention.

The invention concerns a household appliance, such as a dishwasher machine, wherein the household appliance comprises: a support for goods, such as a basket or rack, arranged inside the household appliance; and an arrangement for extracting and retracting the goods support out from and into the household appliance, wherein the extracting and retracting arrangement comprises: first and second rail units extending substantially along and in parallel with each other, wherein the first and second rail units are arranged to be moveable in a longitudinal direction in relation to each other. The extracting and retracting arrangement further comprising first and second sets of roller elements distributed longitudinally between the first and second rail units along first and second opposite outer surfaces of the first rail unit so as to facilitate said relative movement.

The invention is characterized in that the first rail unit at least along one or more segments of its length, is provided with supporting material in a region that extends between and is located intermediate to the first and second opposite outer surfaces so as to allow for absorption of compression forces in the supporting material and resistance of compression deformation of the first rail unit when one or more of the roller elements exerts a force onto any of the outer surfaces.

This means that a supporting material is arranged in the region that extends in-between the first and second outer surfaces, i.e. in-between the roller elements, and that this material is capable of preventing compression of the first rail unit when subject to a compression force exerted by a roller element. It thus means that the first rail unit is designed such that the material itself will absorb the compression forces internally. This follows from the feature that the material is present between and is located intermediate to the first and second outer surfaces. Accordingly, the material is not present only at one or both sides of the region located in-between these surfaces, which would lead to a bending moment when a force presses one of the outer surface towards the other.

That the material is supporting and that the first rail unit can withstand compression deformation means that the material as such is substantially incompressible, i.e. it is not both flexible and porous, and also that the material is arranged in a structure capable of handling a force (within reasonable limits) directed from one of the outer surfaces towards the other outer surface without being significantly compressed. As described below, the material is preferably a plastic or polymeric material (to avoid a more costly steel rail). As to the structure there are several possibilities. One example is to make the first rail unit completely solid between the outer surfaces and along some portion(s)/segment(s) of its length. Another example, which typically saves weight and material, is to provide the first rail unit with a plurality of relatively thin wall members extending across and/or along the rail in a (compression) load absorbing framework. Since a wall member extending across the first rail unit provides the first rail unit with a solid cross section between the outer surfaces, such a wall actually forms a variant of the previous example, i.e. a variant where the first rail unit is completely solid between the outer surfaces but only along a very short portion/segment of its length. Combinations of wall members and other supporting structures are also possible.

That the particular design is applied "at least along one or more segments of its length" means that this design need not necessarily be applied to the entire length of the first rail unit. For instance, some part or parts of the first rail unit might not be located between the roller elements during use and will not be subject to the compression forces discussed above.

The expression "at least along one or more segments of its length" also means that there can be some longitudinal distance between different segments where this design is applied. The reason is that a particular segment can provide compression resistance not only to its exact longitudinal position but also to some portion of the first rail unit located sufficiently close to that particular segment. An example of such a segment is thus a thin wall member extending across the first rail unit, as mentioned above. An example of a design according to this disclosure is thus to distribute a plurality of wall members along (a portion of) the first rail unit, where each wall member forms a "segment" and extends between the first and second outer surface as well as across the first rail unit. Such wall members may extend transversally across the first rail unit or exhibit some angle in relation to the transversal direction. Which longitudinal distance to select between such wall members depend, for instance, on the thickness of the wall members, the general dimensions of the first rail unit, and material thickness of other parts of the first rail unit.

A design as specified above is significantly different than that of the steel rails commonly used in extraction and retraction arrangements for dishwashers. Such steel rails have a substantially C-shaped cross section, where wheels are fitted between the two more or less horizontal parts of the C or where two C-rails of different size (i.e. different height or width) are fitted into each other with (upper and lower) ball bearing elements arranged between the horizontal parts of the C's of the two rails, as exemplified in the arrangement disclosed in EP2891447A1. In such common steel rails there is no material at all "in a region that extends between and is located intermediate to" the opposite outer surfaces (i.e. two more or less horizontal parts of the C) subject to the compression forces. Instead such rails are made of steel of a sufficient quality and thickness so that the horizontal parts of the C-shaped cross section subject to the compression forces can withstand a bending moment and that way prevent that the rail deforms by compression.

It may be noted that the cross section of the common steel rails are rarely shaped exactly like a typical C, but they are typically made from an elongated steel sheet and exhibit after pressing/bending a cross section with two opposite mirror-inverted flanges facing each other, each typically having a concave portion to accommodate a part of e.g. a ball, and a main part that in general extends more or less perpendicularly to the flanges (aside of the region located in-between the "outer surfaces") and that connects end parts of the flanges, which results in a substantially C-shaped cross section.

An effect of providing supporting material in-between the first and second opposite outer surfaces is that the first rail unit does not deform when exposed to compression forces (within reasonable limits) even if produced in a material having lower strength or higher flexibility than the steel used for the conventional C-rails (because the compression forces do not expose the first rail unit to a bending moment). A consequence of this effect is that the first rail unit can be produced in a plastic or polymeric material, such as polypropylene, which significantly reduces the costs for the first rail unit, both because of material costs but also because a plastic rail can be produced more cost-efficiently, by e.g. injection moulding, than forming a C-shaped cross section by press forming a flat steel sheet. Further, injection moulding of plastics has the potential of reducing the tolerances compared to press forming of steel.

Compression forces from the roller elements may arise, for instance, when the goods support is fixed to the first rail unit and the weight of the goods support presses the first rail unit towards roller elements located below the first rail unit or goods are unevenly distributed onto the goods support, e.g. all goods are located at the front (outer) end of a dishwasher basket, so that a resulting torque presses a front (outer) part of the first rail unit downwards and a rear (inner) part upwards).

The roller elements may be balls but may alternatively be cylindrical roller elements.

In an embodiment the first rail unit comprises a plurality of wall members extending across the first rail unit, wherein the wall members constitute at least part of the supporting material between the first and second opposite outer surfaces. As mentioned above, this reduces costs and weight compared to a more solid design. The wall members are preferably distributed along the first rail unit, at least along a portion of its length. The individual wall members may extend transversally or exhibit some angle in relation to the transversal direction. Further, individual wall members may extend in a plane or bent plane. Wall members may also be arranged in the longitudinal direction of the first rail member.

In an embodiment the first rail unit is fixed to the goods support so as to allow the goods support to be extracted in a direction out from the household appliance and to be retracted in a direction into the household appliance while moving the first rail unit in relation to the second rail unit. The first rail unit may be directly or indirectly connected to the goods support.

In an embodiment the first rail unit is provided with a first stopping element configured to interact with a corresponding second stopping element arranged at a fixed position in relation to the second rail unit when the extracting and retracting arrangement is fully extracted so as to, when the first and second stopping elements interact, prevent further extraction of the first rail unit and thereby set a maximum extraction position for the first rail unit in relation to the second rail unit. This prevents the first rail unit to be extracted too far in relation to the second rail unit.

In an embodiment the goods support is directly or indirectly connected to the first rail unit along a connection length that extends in the longitudinal direction of the first rail unit, and wherein less than half of the connection length is located outside of the second rail unit when the first rail unit is in its maximum extraction position in relation to the second rail unit. The connection length relates to the length of the connection at the first rail unit where the weight of the goods support is transferred to the first rail unit. If the first rail unit is allowed to be extracted from the second rail unit so far that the entire connection length is extracted outside the second rail unit, the first rail unit will be exposed to a considerable bending moment, at least when the goods support is loaded with heavy goods. Such a bending moment might be acceptable for a conventional steel rail with C-shaped cross section, but to allow the first rail unit to be made in a plastic or polymeric material and still allow the first rail unit to be sufficiently thin and "weak" to take advantage of the potential of cost-efficiency, this embodiment is designed to allow the first rail to be extracted only so that less than half of the connection length is located outside of the second rail unit. The less the connection length is allowed to be extracted from the second rail unit, the less the first rail unit is exposed to the bending moment. To completely avoid exposing the first rail unit from the bending moment resulting from letting the connection length protrude from the second rail unit, the maximum extraction position for the first rail unit in relation to the second rail unit can be set so that the connection length is not allowed to be located outside the second rail unit at all. If the weight load of the goods support is only partly (or not at all) carried by the first rail unit, the remaining part (or all the load) can be carried by the second rail unit. In such a case the second rail unit can be designed to carry that load and withstand the resulting bending moment, for instance by having the form of or by including a steel rail of conventional type with substantially C-shaped cross section. An advantage is then that it can be avoided that also the first rail unit needs to be a steel rail but can instead be made of a plastic material and being designed to mainly withstand compression forces.

In an embodiment less than 20% of the connection length is located outside of the second rail unit when the first rail unit is in its maximum extraction position in relation to the second rail unit. Preferably, as mentioned above, the connection length is not located outside of the second rail unit at all when the first rail unit is in its maximum extraction position in relation to the second rail unit.

In an embodiment the first and second sets of roller elements are arranged between the first and second opposite outer surfaces of the first rail unit and corresponding opposite first and second inner surfaces of the second rail unit. There is thus (at least) two rows of roller elements, one between the first inner surface and the first outer surface and the other between the second inner surface and the second outer surface. Typically, there is one row below the first rail unit and one row above the first rail unit.

In an embodiment the second rail unit comprises an outer frame made of a metallic material and a rail insert made of a plastic or polymeric material, wherein the rail insert is arranged inside and is fixed to the outer frame. The outer frame may thus be a conventional steel rail with a substantially C-shaped cross section, i.e. a type of rail that has high strength and is capable of handling the bending moment discussed above. The outer shape of the plastic rail insert is preferably adapted to the inner shape of the metallic frame, while the inner shape of the plastic rail insert may be given variety of designs depending on the application, in particular a design adapted to the first rail unit and the roller elements.

A particular advantage of the use of an outer metallic frame and the plastic insert is that an already available second rail outer frame (or even a second rail outer frame already installed in a household appliance), that might be adapted to the conventional extraction and retraction arrangement involving wheels connected to the goods support and adapted to fit into the outer metallic frame, can easily be converted to an extraction and retraction arrangement using roller elements instead of wheels by adapting the plastic rail insert to the existing second rail outer frame and to the first rail unit etc. to be used. The existing outer frame of second rail can still be used for the wheel-solution, e.g. for use with a less costly variant of the household appliance in question. The plastic rail insert can be produced cost efficiently by means of e.g. injection moulding.

In an embodiment the first and second opposite inner surfaces of the second rail unit are arranged in the rail insert. This means that, in this embodiment, the outer metallic frame of the second rail unit, which may be an already available steel rail of the conventional type with substantially C-shaped cross section and that might originally be designed for the wheel solution, is converted to a composite second rail unit by introducing a plastic rail insert inside the frame, and the rail insert is adapted to receive the roller elements and the first rail unit, which preferably also is made of plastics as mentioned above. This is a much more cost efficient solution than redesigning the second steel rail unit and add a further steel rail (i.e. the first rail) of the same type and material as the second rail.

In an embodiment the extracting and retracting arrangement comprises a roller element carrier that holds the first and second sets of roller elements in place at the first and second opposite outer surfaces of the first rail unit.

In an embodiment the roller element carrier is longitudinally moveable in relation to each of the first and second rail units.

In an embodiment the second stopping element is arranged onto the roller element carrier.

In an embodiment the roller element carrier is provided with a third stopping element configured to interact with a corresponding fourth stopping element arranged onto the second rail unit so as to, when the third and fourth stopping elements interact, prevent further extraction of the roller element carrier and thereby set a maximum extraction position for the roller element carrier in relation to the second rail unit.

Accordingly, when the second stopping element is arranged onto the roller element carrier (and not onto the second rail unit), the second stopping element becomes arranged at a fixed position in relation to the second rail unit when the extracting and retracting arrangement is fully extracted and the third and fourth stopping elements interact, i.e. where further extraction of the roller element carrier is prevented and thereby a maximum extraction position for the roller element carrier in relation to the second rail unit is set.

In an embodiment the first rail unit is made of a plastic or polymeric material. As mentioned above, this is more cost efficient than the use of conventional steel rails.

In an embodiment the first rail unit comprises a rail part extending along the roller elements and a connection part that is fixed to the rail part and that is directly or indirectly connected to the goods support. The connection part may be connected to the rail part or the two parts may form an integrated component. The connection between the first rail unit and the goods support may include further parts.

In an embodiment the extracting and retracting arrangement comprises a third rail unit fixed to an inner wall of the household appliance. This third rail may be a conventional steel rail having a substantially C-shaped cross section. The arrangement may include one or more further rails.

The household appliance preferably comprises a similar extracting and retracting arrangement on opposite sides of the goods support. A corresponding third rail may therefore be fixed to an opposite inner wall of the household appliance.

In an embodiment the second rail unit is movably connected to the third rail via third and fourth sets of roller elements distributed longitudinally between the second and third rail units. Accordingly, the arrangement includes in this case three rails. As mentioned above, the third and the second rail units, or at least the third rail and the outer frame of the second rail unit, may be adapted also for another design involving rolling wheels or another type of first rail.

In an embodiment the rail insert is provided with a flexible braking member for slowly decelerate the roller element carrier during extraction before the third and fourth stopping elements interact and the roller element carrier reaches its maximum extraction position, wherein the roller element carrier is provided with a braking activation member arranged to interact with the flexible braking member before the roller element carrier reaches its maximum extraction position, and wherein the flexible braking member is made of a flexible material, has the shape of a closed loop and is oriented in a plane that is substantially parallel with the longitudinal direction of the rail insert.

Accordingly, the flexible braking member has the shape of a circle or ellipse or similar and is oriented such that the roller element carrier, when moving along the second rail unit and the rail insert, will move in a direction substantially in parallel with the orientation plane of the flexible braking member. When the roller element carrier is extracted the braking activation member will thus interact with the flexible braking member and deform the loop. The energy used for deforming the loop slows down the roller element carrier before the third and fourth stopping elements interact and thus provides for a smooth retardation of the roller element carrier when extracted.

The flexible braking member may form an integrated part of the (plastic) rail insert.

Preferably, a corresponding braking arrangement is provided at the other side of the rail insert for providing a smooth retardation of the roller element carrier when retracted into the household appliance.

In an embodiment the household appliance is a dishwasher machine. In such a case the goods support is typically a basket or wire rack for supporting bowls and glasses etc. Alternatively, the household appliance may be e.g. a refrigerator or a freezer.

BRIEF DESCRIPTION OF DRAWINGS

In the description of the embodiments of the invention given below, reference is made to the following figures, in which.

DESCRIPTION OF EXAMPLE EMBODIMENTS OF THE INVENTION

Figure 1:
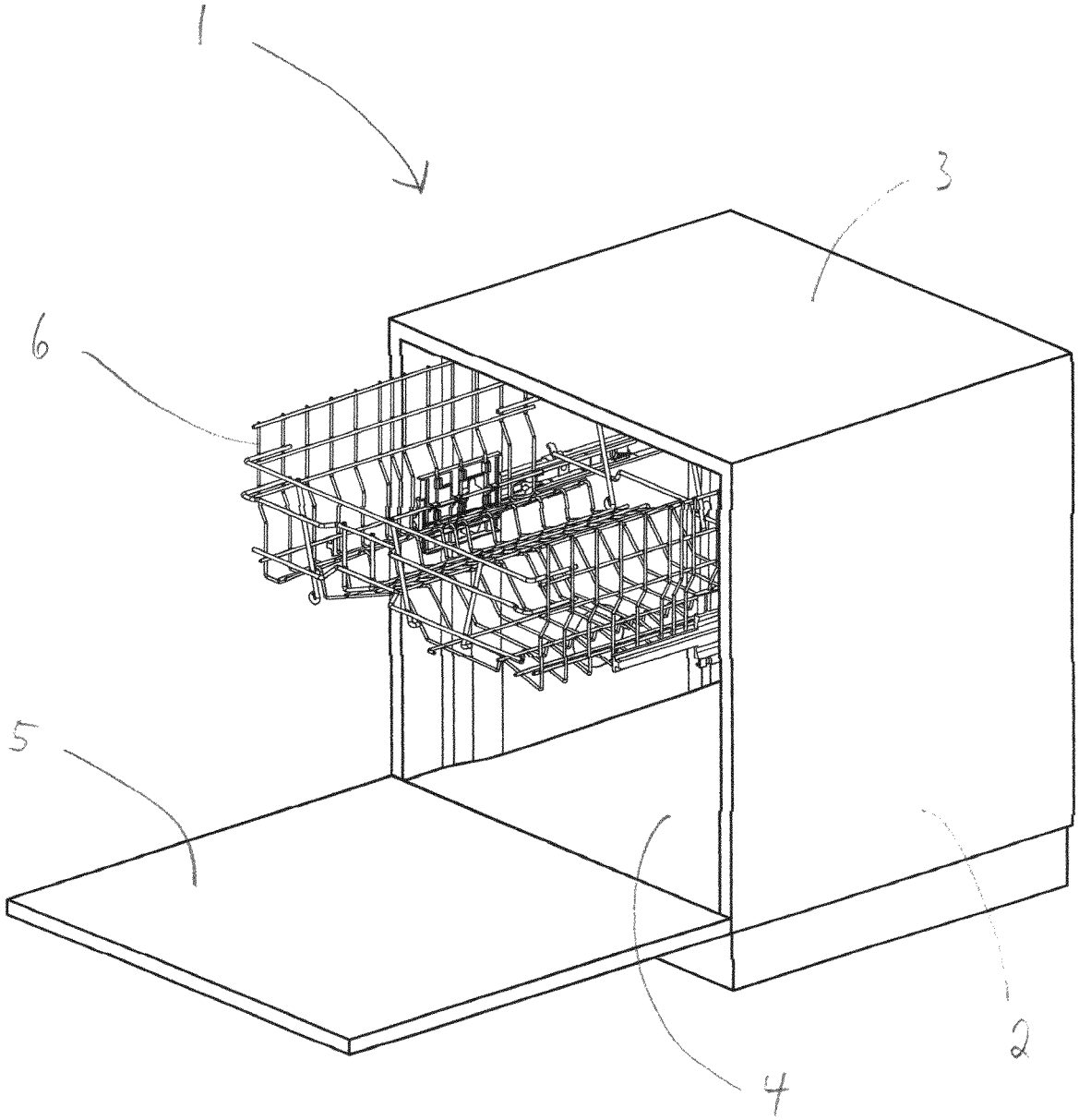
FIG. 1 shows an embodiment of a household appliance in the form of a dishwasher machine.

FIG. 1 shows an embodiment of a household appliance in the form of a dishwasher machine 1. An inner washing chamber of the dishwasher 1 is defined by walls 2, top 3, bottom 4 and door 5, which is open in FIG. 1. An extractable and retractable basket/wire rack 6 for supporting goods like glasses etc. is arranged between sidewalls 2 of the dishwasher 1. The dishwasher 1 is typically provided with further components, such as one or more spray arms and one or more additional baskets. Such components are well known and not shown here.

Figure 2:
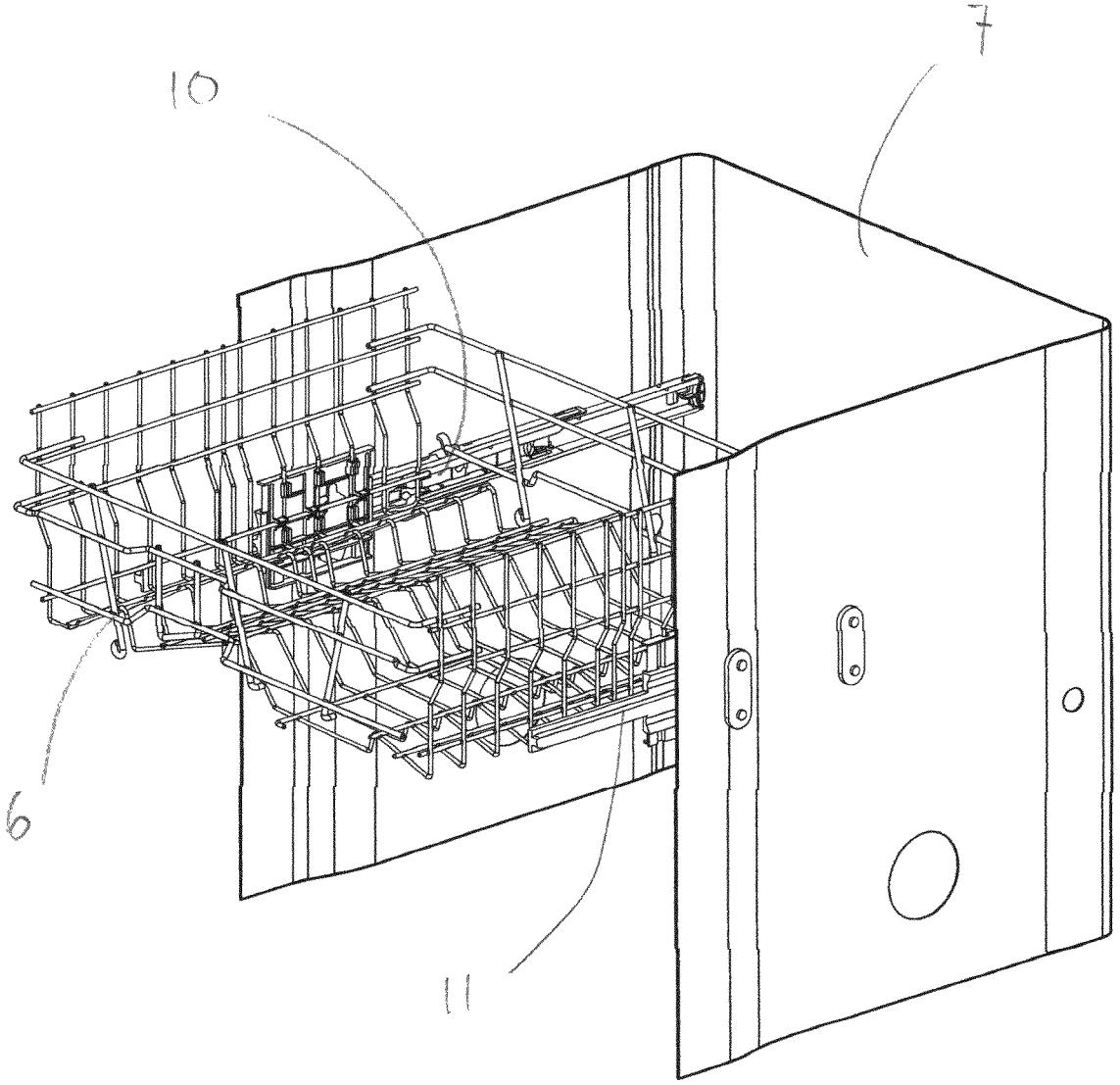
FIG. 2 shows inner parts of the dishwasher of FIG. 1 including a dishwasher basket, an arrangement for extracting and retracting the basket out from and into the dishwasher (one such arrangement on each side of the basket), and an inner frame supporting the extracting and retracting arrangement.

FIG. 2 shows inner parts of the dishwasher 1 of FIG. 1 including the dishwasher basket 6, first and second (left and right) arrangements 10, 11 for extracting and retracting the basket 6 out from and into the dishwasher 1, and an inner wall frame 7 supporting the extracting and retracting arrangements 10, 11. As shown in FIG. 2, the first and second extracting and retracting arrangements 10, 11 are arranged on opposite sides of the horizontally oriented basket 6 and connected to the corresponding side of the wall frame 7. The first and second extracting and retracting arrangements 10, 11 have in this example an identical but mirror-inverted design. The detailed description below focuses on the first (left) extracting and retracting arrangement 10.

Figure 3:
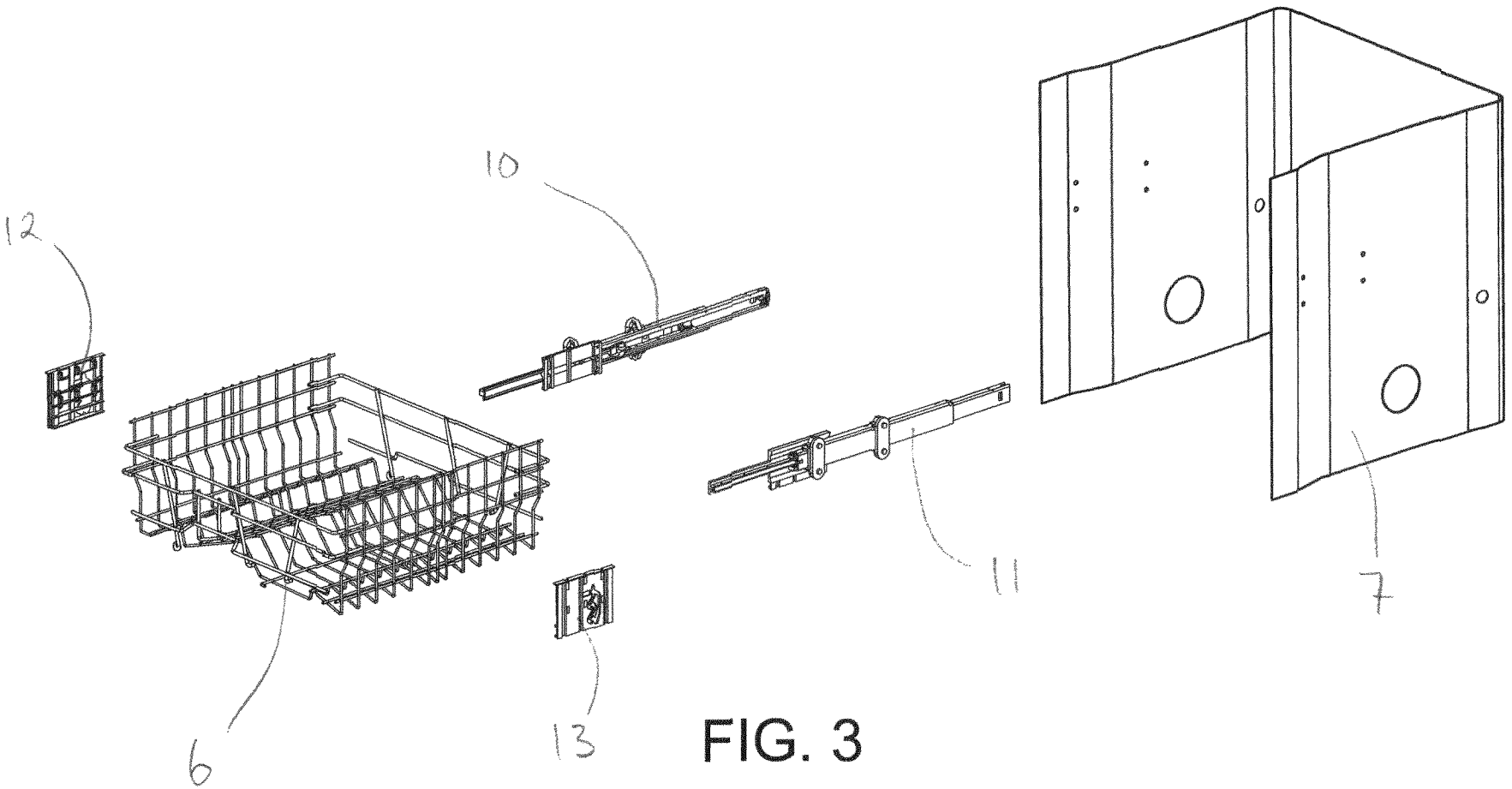
FIG. 3 shows an exploded view of the general parts of FIG. 2.

FIG. 3 shows an exploded view of the parts shown in FIG. 2. First and second connection components 12, 13 connects the basket 6 to the corresponding extracting and retracting arrangement 10, 11.

As shown in e.g. FIGS. 4, 7, 8 and 10, the first (left) extracting and retracting arrangement 10 (and also the second arrangement 11) comprises first, second and third rail units 15, 17/18, 20 extending substantially along and in parallel with each other. The first and second rail units 15, 17/18 are arranged to be moveable in a longitudinal direction in relation to each other. Also the second and third rail units 17/18, 20 are arranged to be moveable in a longitudinal direction in relation to each other. The third rail unit 20 is fixed to the wall frame 7 by means of brackets 21, 22.

The third rail unit 20 is in this example a conventional steel rail having a substantially C-shaped cross section. The second rail unit 17/18 comprises in this example two main elongated parts that are combined into one rail unit: an outer steel frame 18 and a rail insert 17 made of a plastic or polymeric material, wherein the rail insert 17 is arranged inside and along the outer frame 18 and is fixed thereto. The outer steel frame 18 is also a conventional steel rail having a substantially C-shaped cross section, although with somewhat smaller dimensions so as allow the second rail unit 17/18 to be arranged inside and along the third rail unit 20.

The first rail unit 15 is, like the rail insert 17, made of a plastic or polymeric material. The first rail unit 15 is fixed to the basket 6, via connection component 12, so as to allow the basket 6 to be extracted in a direction out from the dishwasher 1 and to be retracted in a direction into the dishwasher while moving the first rail unit 15 in relation to at least one of the second and third rail units 17/18, 20 (and in relation to both the second and the third rail units 17/18, 20 if moved between maximum extraction and maximum retraction positions).

Figure 9:
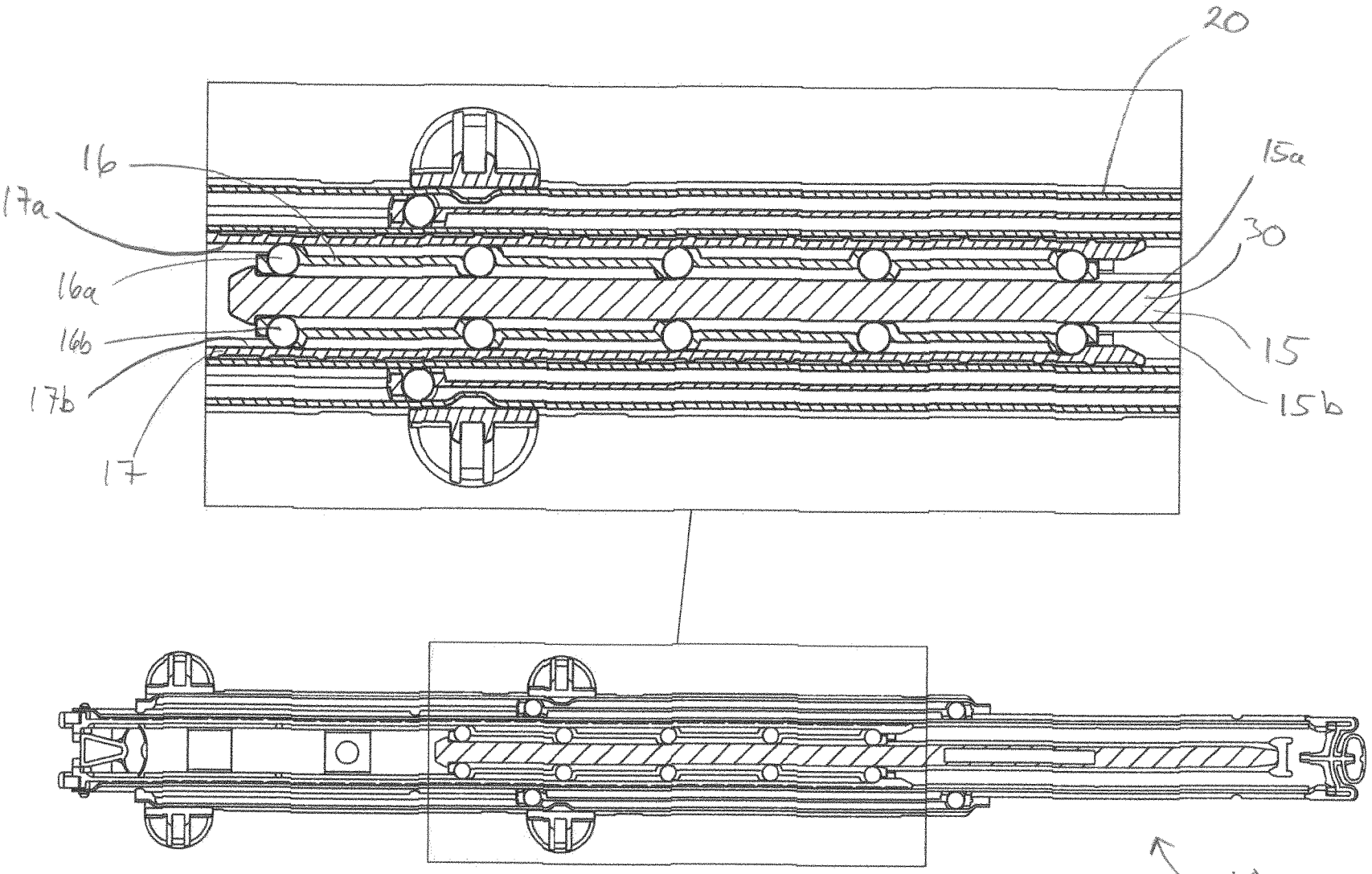
FIG. 9 shows a longitudinal cross section of the extracting and retracting arrangement of FIG. 8.
Figure 10:
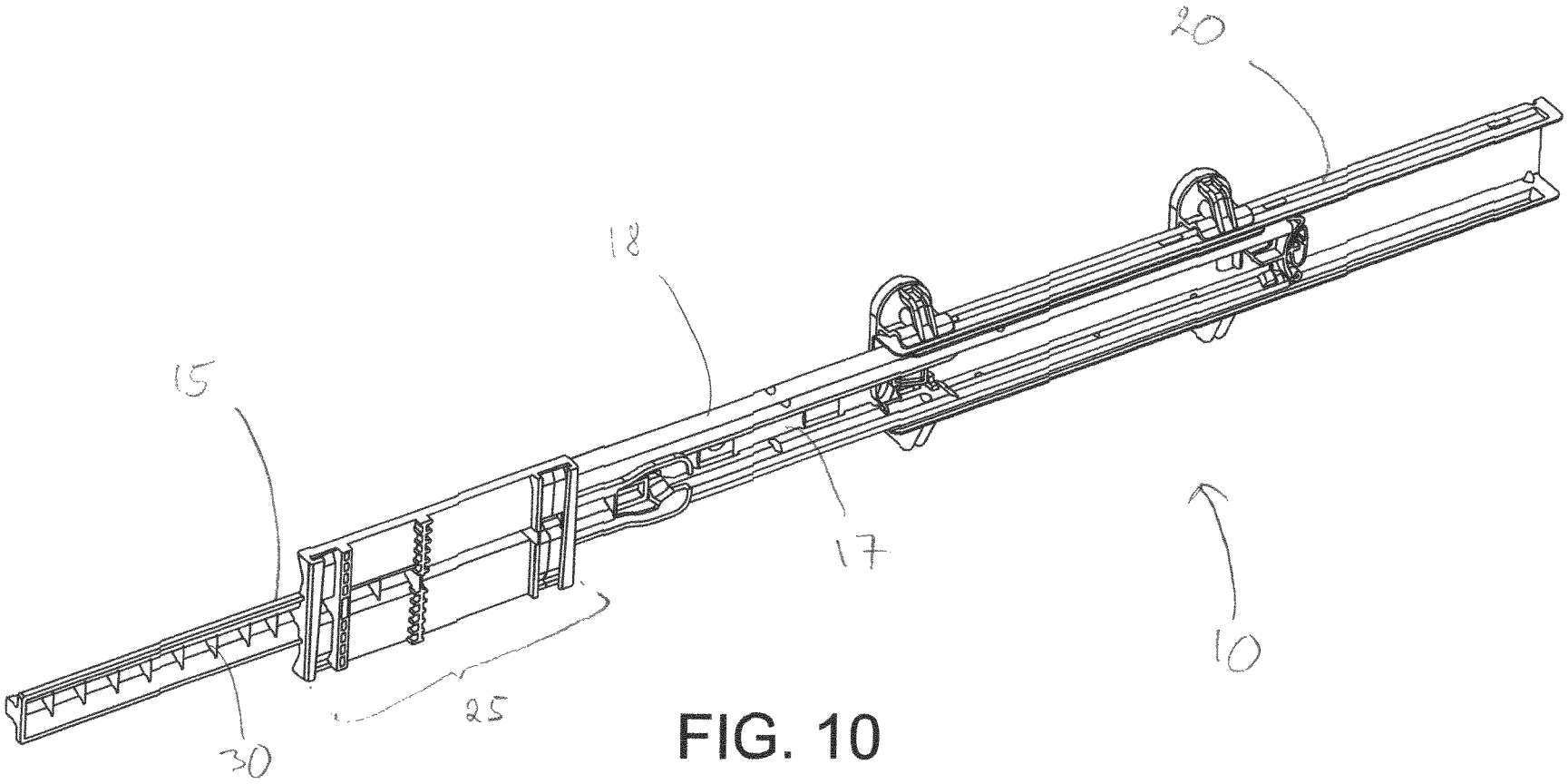
FIG. 10 shows a perspective view of the extracting and retracting arrangement in an extracted position.

The arrangement 10 further comprises first and second sets of roller elements in the form of balls 16*a*, 16*b* (see e.g. FIGS. 9 and 11) distributed longitudinally between the first and second rail units 15, 17/18 (actually between the first rail unit 15 and the rail insert 17 of the second rail unit 17/18, see below) along first and second opposite outer surfaces 15*a*, 15*b* of the first rail unit 15 so as to facilitate the relative movement between the first and second rail units 15, 17/18. More specifically, the first and second sets of balls 16*a*, 16*b* are arranged between the first and second opposite outer surfaces 15*a*, 15*b* of the first rail unit 15 and corresponding opposite first and second inner surfaces 17*a*, 17*b* of the second rail unit 17/18, which first and second inner surfaces 17*a*, 17*b* in this case are formed in the rail insert 17 fixed to and arranged inside the frame 18 of the second rail unit 17/18 (see e.g. FIG. 7).

A first roller element carrier 16 holds the balls 16*a*, 16*b* in place at a certain distance from each other in the longitudinal direction of the first and second rail units 15, 17/18. The first roller element carrier 16 is longitudinally moveable in relation to each of the first and second rail units 15, 17/18.

To facilitate relative movement between the second and third rail units 17/18, 20, there is an additional and structurally similar ball bearing arrangement provided also between these two rail units. This additional ball bearing arrangement comprises third and fourth sets of balls 19*a*, 19*b* distributed longitudinally between the second and third rail units 17/18, 20 (actually between the outer frame 18 of the second rail unit 17/18 and the third rail unit 20, see e.g. FIG. 7), where the balls 19*a*, 19*b* are carried by a second roller element carrier 19 that is longitudinally moveable in relation to each of the second and third rail units 17/18, 20.

Figure 6:
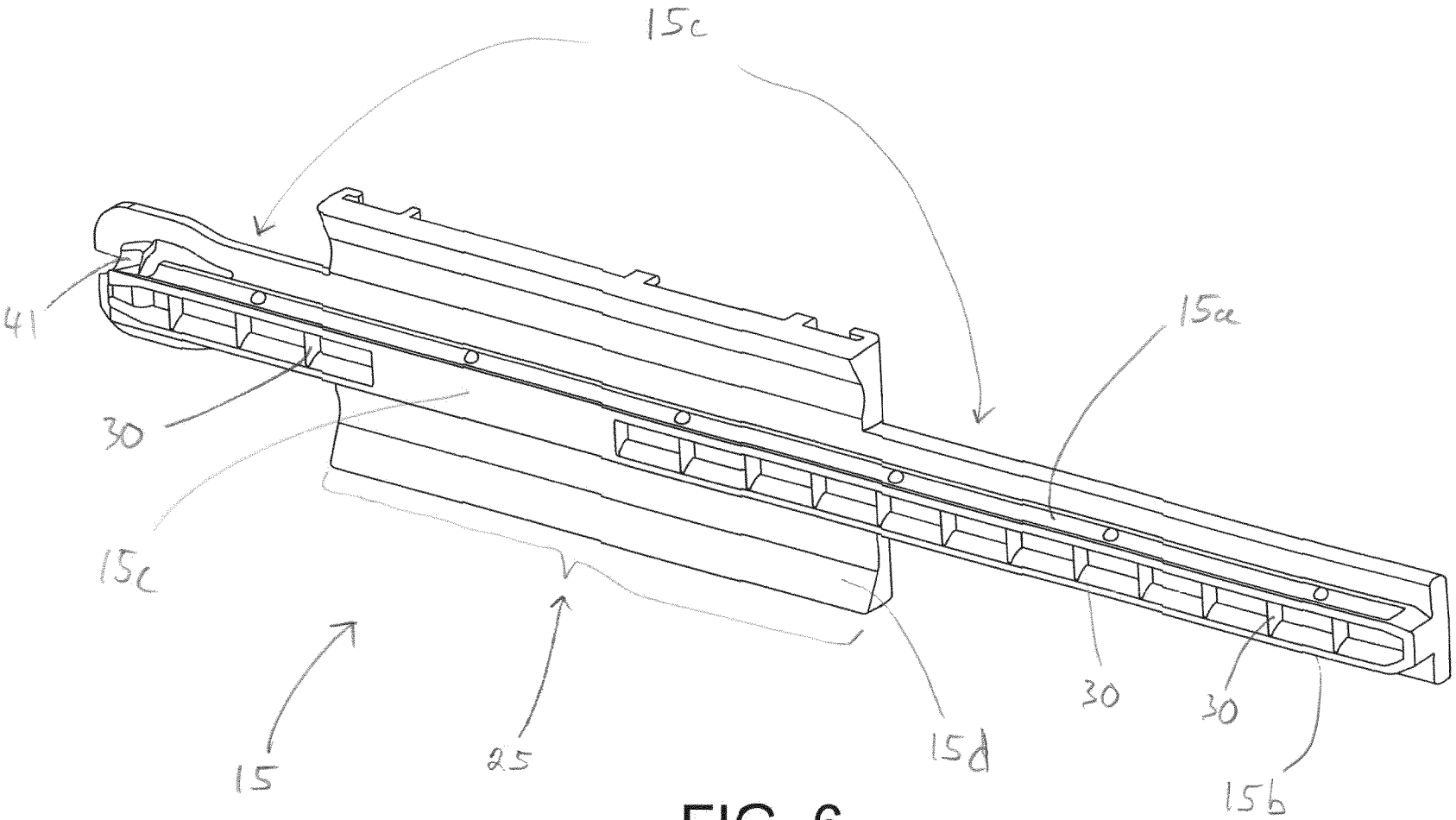
FIG. 6 shows a first rail unit of the extracting and retracting arrangement.

As shown in FIG. 6, the first rail unit 15 comprises a rail part 15*c* extending along the other rails (and along e.g. the rows of balls 16*a*, 16*b*) and a connection part 15*d* that is fixed to the rail part 15*c*. In this case the rail part 15*c* and the connection part 15*d* forms one integrated part that, for instance, can be made by injection moulding. The first rail unit 15 is, via connection part 15*d*, in this example indirectly connected to the basket 6 via connection component 12. The connection component 12 is arranged onto the connection part 15*d* (by sliding it downwardly along the connection part 15*d* with ridges fitted into grooves) so that the weight of the basket 6, i.e. the load to be carried by the first rail unit 15, is distributed to the first rail unit 15 along a connection length 25 corresponding to the length of the connection part 15*d* as indicated in FIG. 6. The load-transferring connection between the basket 6 and the first rail unit 15 may be arranged in different ways, but the length and location of this connection is of particular interest in this disclosure as further explained below.

Figure 4:
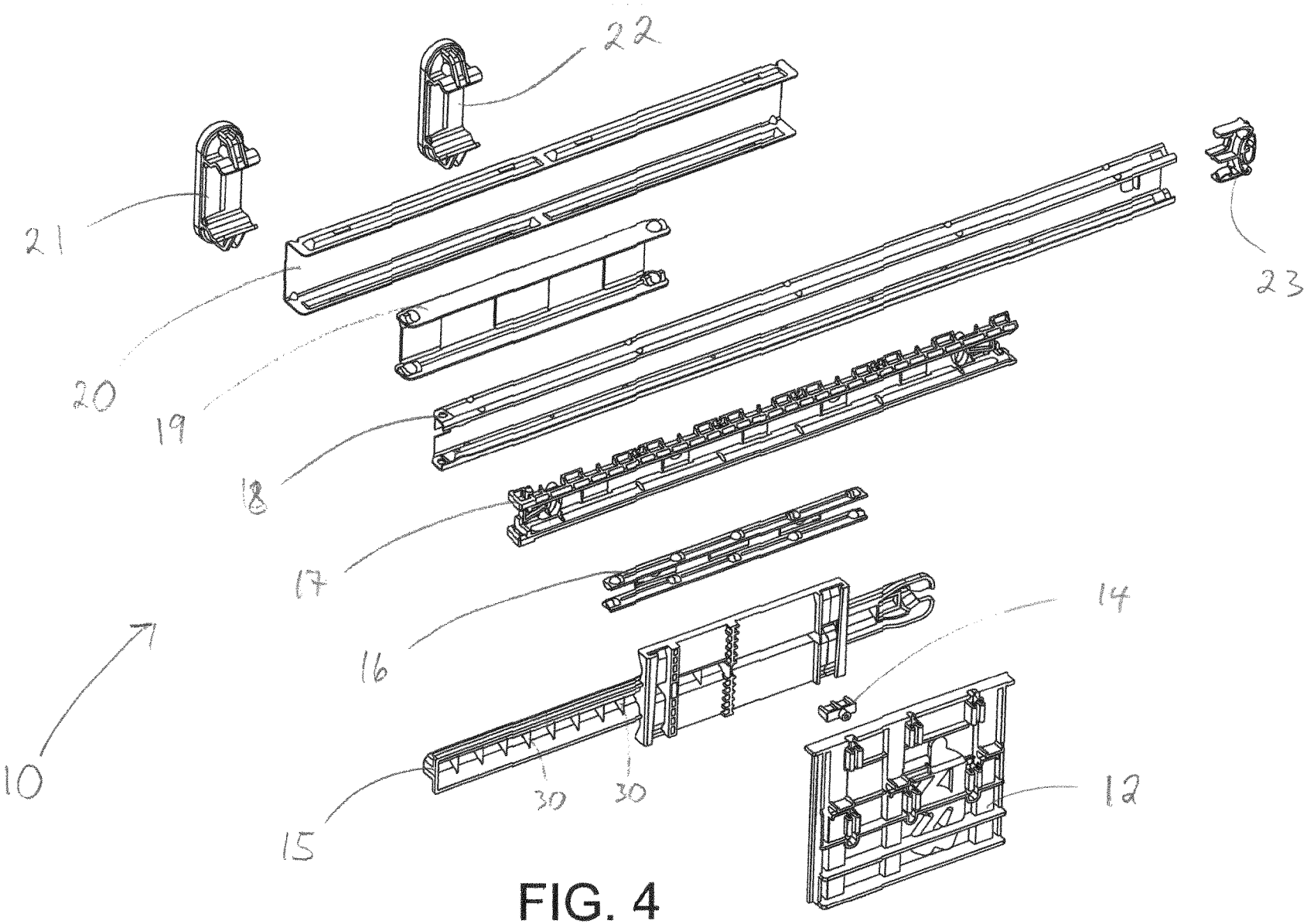
FIG. 4 shows an exploded view of one of the extracting and retracting arrangements.
Figure 5B:
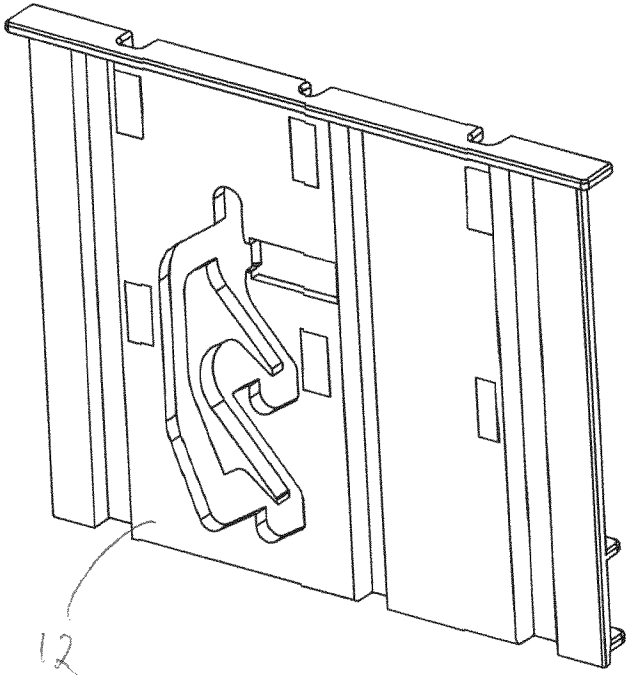
FIG. 5B shows an inwardly facing side of the part of FIG. 5A.
Figure 5A:
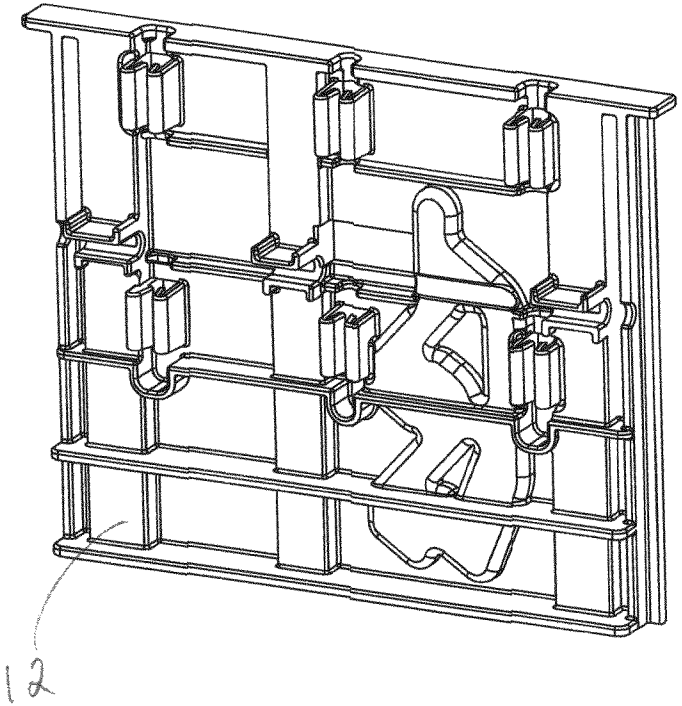
FIG. 5A shows an outwardly facing side of a part that connects the basket to one of the extracting and retracting arrangement.
Figure 7:
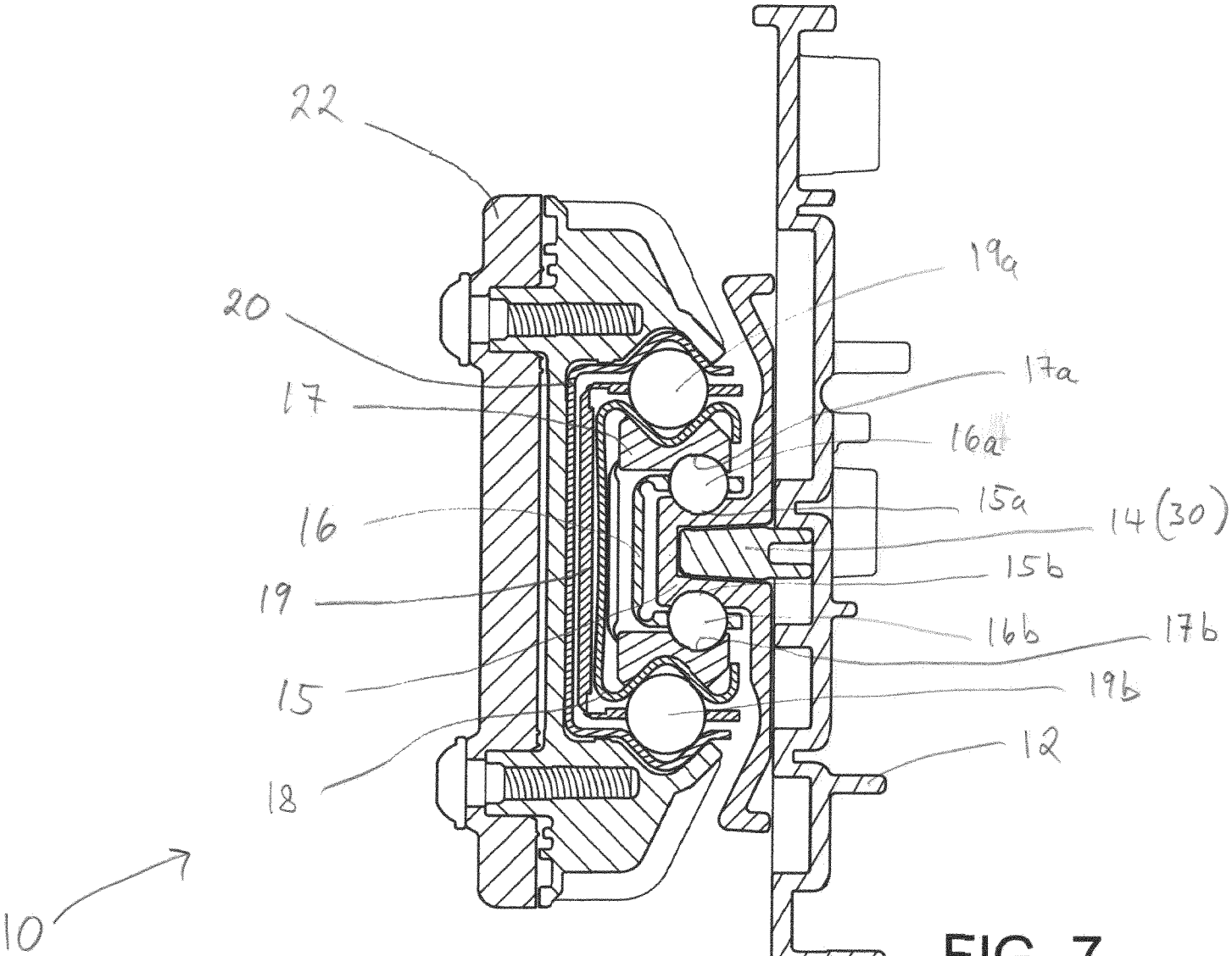
FIG. 7 shows a cross section of the extracting and retracting arrangement.
Figure 8:
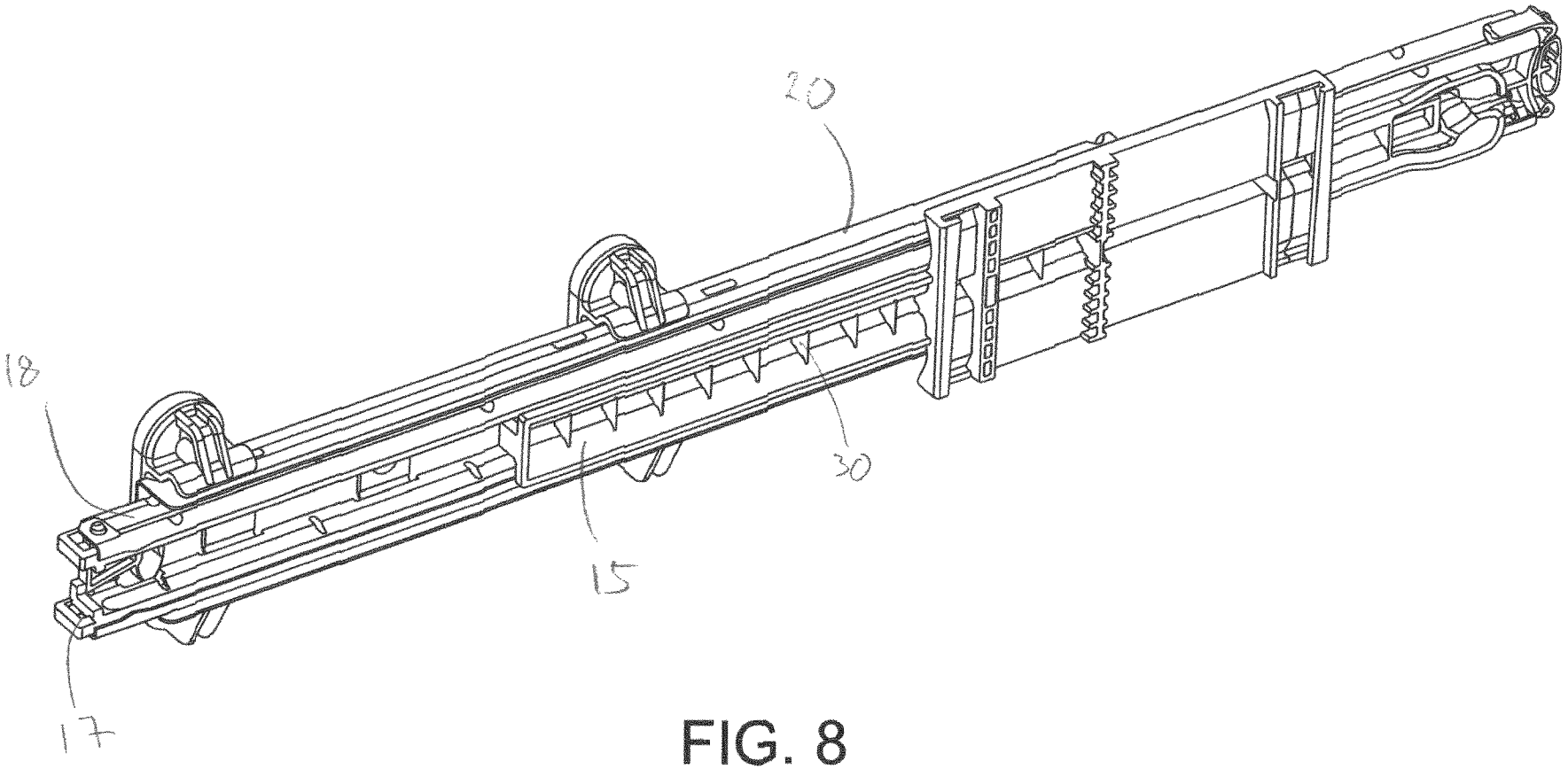
FIG. 8 shows a perspective view of the extracting and retracting arrangement in a retracted position.

The connection component 12 has in this example a particular design related to a function for raising and lowering the basket 6, which also involves the detail 14 shown in FIGS. 4 and 7. This raising/lowering function is not of particular interest for this disclosure, but it should be noted that the detail 14 can be considered to form part of the first rail unit 15 as further explained below.

The first rail unit 15 has a particular design compared to a conventional steel rail, such as the third rail unit 20, namely that the first rail unit 15 is provided with supporting material 30, 14 between the first and second opposite outer surfaces 15*a*, 15*b* so as to withstand compression deformation when one or more of the balls 16*a*, 16*b* exerts a force onto any of the outer surfaces 15*a*, 15*b*, see e.g. FIGS. 4, 6, 7 and 11. When the first rail unit 15 is compressed between the outer surfaces 15*a*, 15*b*, the supporting material in-between is subject to compression forces, which are relatively easy to withstand for most construction materials, including e.g. plastic materials, compared to bending forces and similar which the end flanges of conventional steel rails are subject to in a similar situation. This design thus provides for making the first rail unit 15 in a plastic or polymeric material instead of steel, which typically is more costly.

Figure 11:
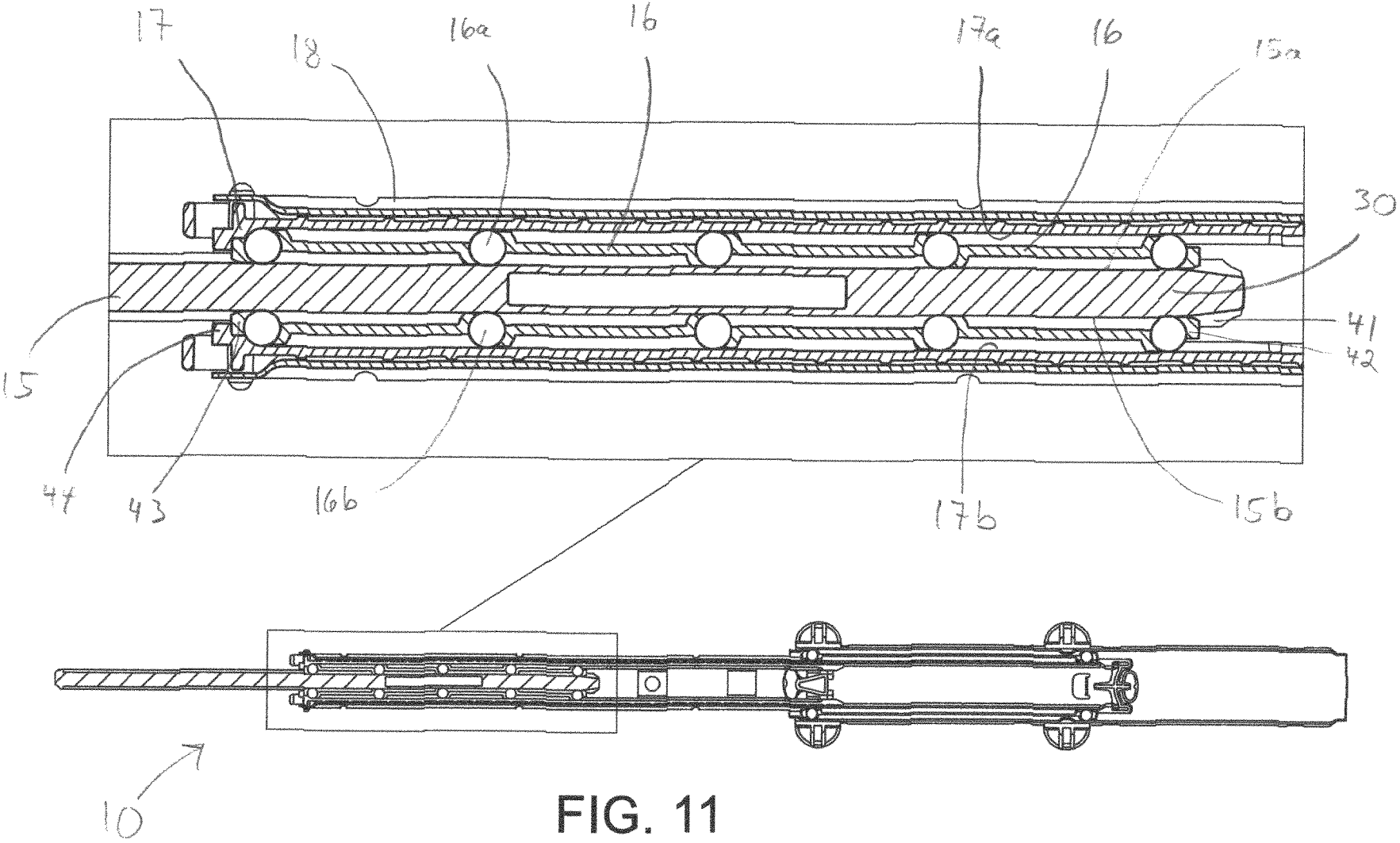
FIG. 11 shows a longitudinal cross section of the extracting and retracting arrangement of FIG. 10.

In the example shown here the first rail unit 15 comprises a plurality of wall members 30 extending across, in this case transversally across, the first rail unit 15, wherein the wall members 30 constitute at least part of the supporting material between the first and second opposite outer surfaces 15*a*, 15*b*. FIGS. 6 and 11 show, or at least indicate, that the first rail unit 15 further is provided with a wall member that extends along the first rail unit 15 (the cross section in FIG. 11 is taken along this longitudinally extending wall member). As shown in FIG. 7, also the detail 14 forms part of the supporting material arranged between and intermediate to the first and second opposite outer surfaces 15*a*, 15*b*. With another type of connection between the first rail unit 15 and the basket 6, i.e. a connection not involving the particular connection component 12, it might instead be possible to arrange further crossing wall members 30 in the region where the detail 14 is located.

The first rail unit 15 is further provided with a first stopping element 41 configured to interact with a corresponding second stopping element 42 arranged at a fixed position in relation to the second rail unit 17/18 when the extracting and retracting arrangement 10 is fully extracted (see FIG. 11). Thus, when the first and second stopping elements 41, 42 interact, further extraction of the first rail unit 15 is prevented and thereby a maximum extraction position for the first rail unit 15 in relation to the second rail unit 17/18 is set.

In this example the second stopping element 42 is arranged onto the first roller element carrier 16. In turn, the first roller element carrier 16 is provided with a third stopping element 43 configured to interact with a corresponding fourth stopping element 44 arranged onto the second rail unit 17/18, or more specifically onto the rail insert 17 that is fixed to the metal outer frame 18 (see FIG. 11). Thus, when the third and fourth stopping elements 43, 44 interact, further extraction of the first roller element carrier 16 is prevented and thereby a maximum extraction position for the first roller element carrier 16 in relation to the second rail unit 17/18 is set. This sets in turn a fixed position for the second stopping element 42 in relation to the second rail unit 17/18 when the extracting and retracting arrangement 10 is fully extracted (see FIG. 11).

As mentioned above, the basket 6 is connected to the first rail unit 15 along a connection length 25 that extends in the longitudinal direction of the first rail unit 15. The embodiment shown here is configured such that nothing or only a very small part of the connection length 25, i.e. clearly less than half of the connection length 25, is located outside of the second rail unit 17/18, in particular in relation to the outer frame 18, when the first rail unit 15 is in its maximum extraction position in relation to the second rail unit 17/18 (see e.g. FIGS. 10-11). The weight of the basket 6 can thereby be carried by the outer steel frame 18 of the second rail unit 17/18 also when the extracting and retracting arrangement 10 is fully extracted. This way the first rail unit 15 does not have to be exposed to any significant bending moment, which also provides for making the first rail unit 15 in a plastic or polymeric material instead of steel.

The extracting and retracting arrangement 10 is configured so that the outer steel frame 18 of the second rail unit 17/18 carries the weight and handles the bending moment also when the extracting and retracting arrangement 10 is fully retracted, and also when in a position between fully extracted and fully retracted.

Figure 12:
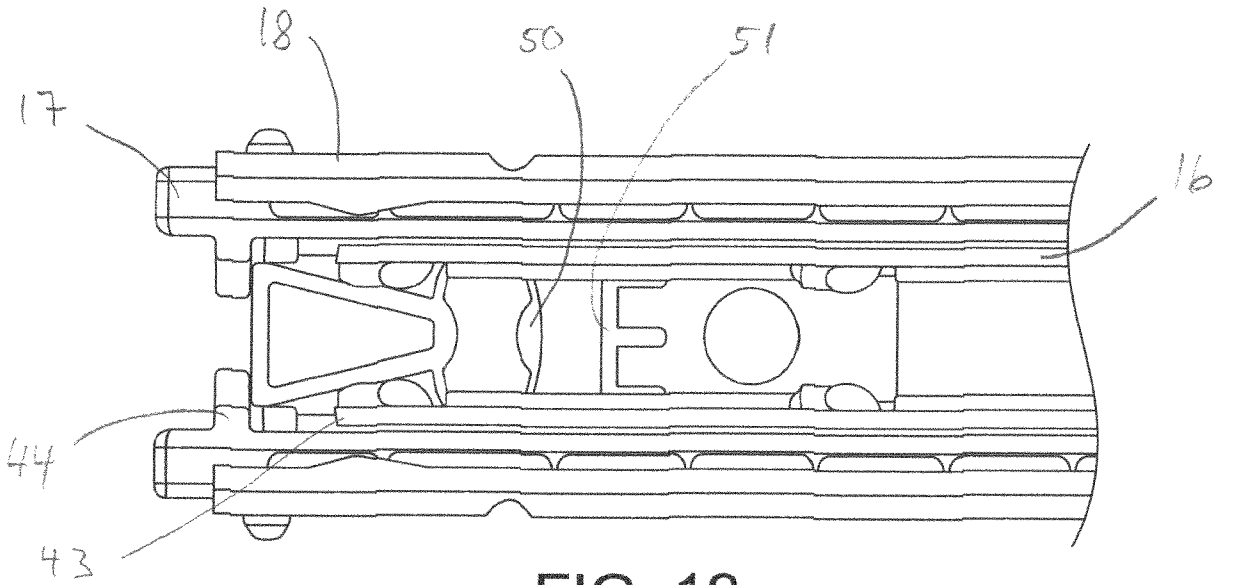
FIG. 12 shows a roller element carrier in a position close to a maximum extraction position in relation to a second rail unit of the extracting and retracting arrangement.
Figure 13:
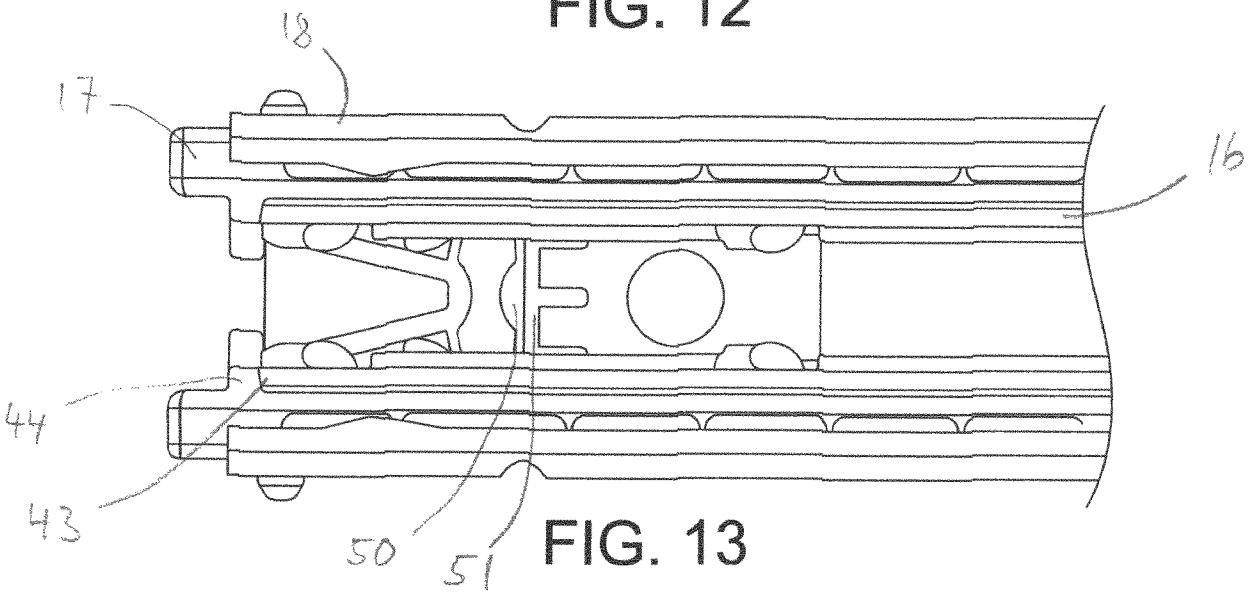
FIG. 13 shows the roller element carrier of FIG. 12 in the maximum extraction position in relation to the second rail unit.

The rail insert 17 is provided with a flexible braking member 50 for slowly decelerate the first roller element carrier 16 during extraction before the third and fourth stopping elements 43, 44 interact and the first roller element carrier 16 reaches its maximum extraction position, see FIGS. 12-13.

The first roller element carrier 16 is provided with a braking activation member 51 arranged to interact with the flexible braking member 50 before the first roller element carrier 16 reaches its maximum extraction position.

The flexible braking member 50 is made of a flexible material, has the shape of a closed loop and is oriented in a plane that is substantially parallel with the longitudinal direction of the rail insert 17. As shown in FIGS. 12-13, the flexible braking member has the form of an ellipse and is oriented vertically.

FIG. 12 shows the first roller element carrier 16 in a position close to a maximum extraction position in relation to the second rail unit 17/18. FIG. 13 shows the first roller element carrier 16 in the maximum extraction position where the third and fourth stopping elements 43, 44 interact. As shown in FIG. 13, the elliptic flexible braking member 50 has slightly deformed and thereby slowly decelerated the first roller element carrier 16 during extraction before the third and fourth stopping elements 43, 44 interact As noted above, FIGS. 4-13 provide various views of the extracting and retracting arrangement 10.

The invention is not limited by the embodiments described above but can be modified in various ways within the scope of the claims. For instance, the supporting material may be continuously distributed between the opposite outer surfaces along the first rail unit, or be distributed in relatively long segments, instead of forming thin wall members (that form very short longitudinal segments when extending across the rail). However, a distribution of wall members can withstand compression deformation and is useful for saving weight and material costs.

Further, the connection between the first rail unit to the basket/goods support may be arranged in different ways, for instance by using a plurality of brackets or connection rods distributed over some longitudinal distance that would form the connection length.

Moreover, the extracting and retracting arrangement does not necessarily have to comprise three rail units, and e.g. the second rail unit may have a different design.

The invention claimed is:

1. A household appliance, comprising:

a support for goods arranged inside the household appliance, and an arrangement for extracting and retracting the support out from and into the household appliance, wherein the extracting and retracting arrangement comprises:

first and second rail units extending substantially along and in parallel with each other, wherein the first and second rail units are arranged to be moveable in a longitudinal direction in relation to each other; and first and second sets of roller elements distributed longitudinally between the first and second rail units along first and second opposite outer surfaces of the first rail unit so as to facilitate said relative movement, wherein the first rail unit, at least along one or more segments of its length, is provided with supporting material in a region that extends between and is located intermediate to the first and second opposite outer surfaces so as to allow for absorption of compression forces in the supporting material and resistance of compression deformation of the first rail unit when one or more of the roller elements exerts a force onto any of the outer surfaces, wherein the first and second sets of roller elements are arranged between the first and second opposite outer surfaces of the first rail unit and corresponding opposite first and second inner surfaces of the second rail unit, wherein the second rail unit comprises an outer frame made of a metallic material and a rail insert made of a plastic or polymeric material, wherein the rail insert is arranged inside and is fixed to the outer frame, and wherein the first and second opposite inner surfaces of the second rail unit are arranged in the rail insert.

2. The household appliance according to claim 1, wherein the first rail unit comprises a plurality of wall members extending across the first rail unit, wherein the wall members constitute at least part of the supporting material between the first and second opposite outer surfaces.

3. The household appliance according to claim 1, wherein the first rail unit is fixed to the goods support so as to allow the goods support to be extracted in a direction out from the household appliance and to be retracted in a direction into the household appliance while moving the first rail unit in relation to the second rail unit.

4. The household appliance according to claim 1, wherein the first rail unit is provided with a first stopping element configured to interact with a corresponding second stopping element arranged at a fixed position in relation to the second rail unit when the extracting and retracting arrangement is fully extracted so as to, when the first and second stopping elements interact, prevent further extraction of the first rail unit and thereby set a maximum extraction position for the first rail unit in relation to the second rail unit.

5. The household appliance according to claim 4, wherein the goods support is directly or indirectly connected to the first rail unit along a connection length that extends in the longitudinal direction of the first rail unit, and wherein less than half of the connection length is located outside of the second rail unit when the first rail unit is in its maximum extraction position in relation to the second rail unit.

6. The household appliance according to claim 5, wherein less than 20% of the connection length is located outside of the second rail unit when the first rail unit is in its maximum extraction position in relation to the second rail unit.

7. The household appliance according to claim 4, wherein the second stopping element is arranged onto the roller element carrier.

8. The household appliance according to claim 1, wherein the extracting and retracting arrangement comprises a first roller element carrier that holds the first and second sets of roller elements in place at the first and second opposite outer surfaces of the first rail unit.

9. The household appliance according to claim 8, wherein the roller element carrier is provided with a third stopping element configured to interact with a corresponding fourth stopping element arranged onto the second rail unit so as to, when the third and fourth stopping elements interact, prevent further extraction of the roller element carrier and thereby set a maximum extraction position for the roller element carrier in relation to the second rail unit.

10. The household appliance according to claim 9, wherein the rail insert is provided with a flexible braking member for slowly decelerating the roller element carrier during extraction before the third and fourth stopping elements interact and the roller element carrier reaches its maximum extraction position, and wherein the roller element carrier is provided with a braking activation member arranged to interact with the flexible braking member before the roller element carrier reaches its maximum extraction position.

11. The household appliance according to claim 10, wherein the flexible braking member is made of a flexible material, has the shape of a closed loop and is oriented in a plane that is substantially parallel with the longitudinal direction of the rail insert.

12. The household appliance according to claim 8, wherein the roller element carrier is longitudinally moveable in relation to each of the first and second rail units.

13. The household appliance according to claim 1, wherein the first rail unit substantially is made of a plastic or polymeric material.

14. The household appliance according to claim 1, wherein the first rail unit comprises a rail part extending along the roller elements and a connection part that is fixed to the rail part and that is directly or indirectly connected to the goods support.

15. The household appliance according to claim 1, wherein the extracting and retracting arrangement further comprises a third rail unit fixed to an inner wall of the household appliance.

16. The household appliance according to claim 15, wherein the second rail unit is movably connected to the third rail unit via third and fourth sets of roller elements distributed longitudinally between the second and third rail units.

17. The household appliance according to claim 1, wherein the household appliance is a dishwasher machine.

* * * * *